United States Patent [19]

Pizzirani

[11] Patent Number: 4,606,693

[45] Date of Patent: Aug. 19, 1986

[54] RIGGED TRUCK, IN PARTICULAR FOR DITCH CLEARING

[76] Inventor: Cesare Pizzirani, Via Giardini 13, Bologna, Italy

[21] Appl. No.: 636,441

[22] Filed: Jul. 31, 1984

[30] Foreign Application Priority Data

Aug. 8, 1983 [IT] Italy ..... 3529 A/83

[51] Int. Cl.[4] ..... B66F 9/06

[52] U.S. Cl. ..... 414/694; 414/695

[58] Field of Search ..... 414/694, 695, 687, 549, 414/917, 550; 37/103, 117.5

[56] References Cited

U.S. PATENT DOCUMENTS

| | | | |
|---|---|---|---|
| 3,298,547 | 1/1967 | Williams | 414/695 |
| 3,313,431 | 4/1967 | Kelly | 414/694 |
| 3,669,285 | 6/1972 | Neff | 414/695 |
| 3,933,259 | 1/1976 | Irving | 414/695 |
| 4,077,140 | 3/1978 | Branconi | 37/103 |
| 4,373,856 | 2/1983 | Taylor | 414/549 |
| 4,433,495 | 2/1984 | Kishi | 414/694 |

FOREIGN PATENT DOCUMENTS

| | | | |
|---|---|---|---|
| 56-10601 | 8/1982 | Japan | 414/694 |
| 57-190842 | 11/1982 | Japan | 414/694 |

*Primary Examiner*—Joseph E. Valenza
*Assistant Examiner*—Kyle E. Shane
*Attorney, Agent, or Firm*—Guido Modiano; Albert Josif

[57] ABSTRACT

A rigged truck comprises runways defined on the truck platform and extending lengthwise thereto close to a corresponding truck side, a carriage mounted for movement along said runways, a tower mounted rotatably on said carriage and having an operator's seat at the top, a main support which is carried, through a horizontal axis articulated parallelogram, cantilever-fashion on said tower and is movable in a vertical direction, a secondary support mounted rotatable about a vertical axis on said main support, an arm mounted at one of its ends oscillably on the secondary support about a horizontal axis lying substantially parallel to the plane containing said articulated parallelogram, and a boom mounted oscillably at the other end of said arm and being terminated with a tool end.

8 Claims, 4 Drawing Figures

RIGGED TRUCK, IN PARTICULAR FOR DITCH CLEARING

BACKGROUND OF THE INVENTION

This invention relates to a rigged truck, in particular for ditch clearing and excavating.

Several types of ditch excavating and ditch clearing machines are known which are usually tractor-mounted. Since such machines are mostly operated on cleared ground, dirt and any materials removed by such machines do not pose, as a rule, special problems as regards their disposal. Not infrequently, in fact, the escavated dirt is merely thrown out of the escavation site and scattered around.

Of course, this would not be permissible where a ditch extends alongside a road.

SUMMARY OF THE INVENTION

It is an object of this invention to provide a truck so rigged as to be able to properly and economically perform maintenance work on ditches adjacent to roads, while being sufficiently versatile to be also suitable for other jobs.

A further object of this invention is to provide a rigged truck as indicated, which is of simple construction, easy to operate, safe in use, and economically advantageous both in investment and running costs.

These objects are achieved by this rigged truck being characterized in that it comprises runways defined on the truck platform and extending lengthwise thereto close to a corresponding truck side, a carriage mounted for crontolled movement along said runways, a tower mounted for controlled rotation on said carriage and carrying at the top a pivotable seat for an operator, a main support carried, through a horizontal axis articulated parallelogram, cantilever-fashion on said tower and being controllably movable in a vertical direction, a secondary support mounted for controlled rotation about a vertical axis on said main support, an arm having one end mounted, for controlled oscillation about a horizontal axis lying substantially parallel to the plane containing said articulated parallelogram, to said secondary support, a boom mounted for controlled oscillation at the other end of said arm and being terminated with a working tool, preferably of the bucket type.

BRIEF DESCRIPTION OF THE DRAWINGS

Further details will be apparent from the following description of a preferred embodiment of a rigged truck according to the invention, as illustrated by way of example only in the accompanying drawings, where.

DESCRIPTION OF THE PREFERRED EMBODIMENTS

Figure 1:
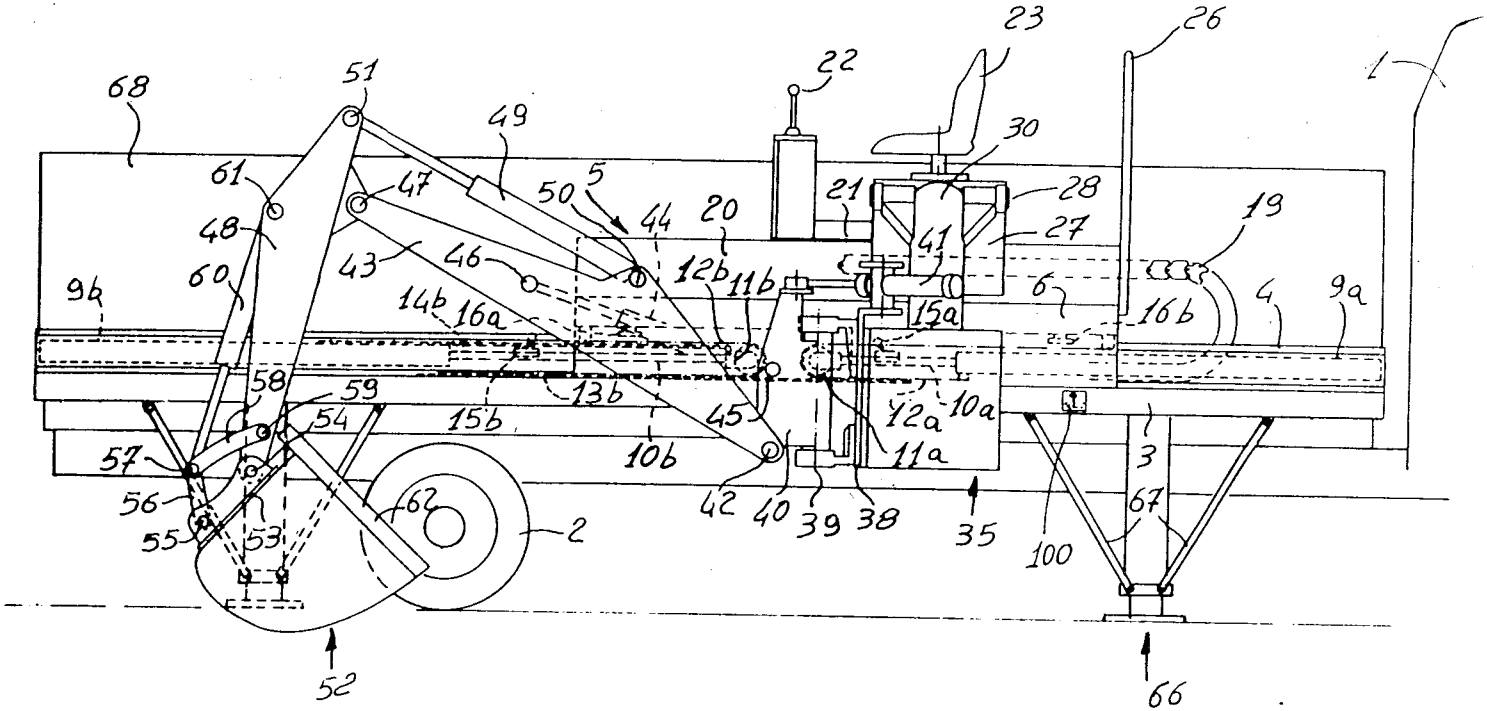
FIG. 1 is a longitudinal elevation view of the rigged portion of this truck.

With reference in particular to the drawing views, indicated at 1,2 and 3, respectively, are the truck driver cab, rear wheels, and platform of this truck. The platform 3 has a pair of runways 4 attached which extend longitudinally thereto; a first runway is located on one longitudinal side, in practice the right-hand side of the platform, and the other at a given distance from the first. Such horizontal runways are engaged by a carriage 5 in running relationship therewith, which carriage comprises a pair of substantially vertical sides 6 interconnected at the top by horizontal cross-beams 7. In practice, the runways 4 comprise parallel, juxtaposed, channeled members, their channeled sides facing outwardly; the substantially vertical sides 6 of the carriage 5 are located outwardly of the runways and at their lower edge carry a set of rollers 8, which engage with the runways 4, some of which have a horizontal axis and some a vertical axis.

Figure 4:
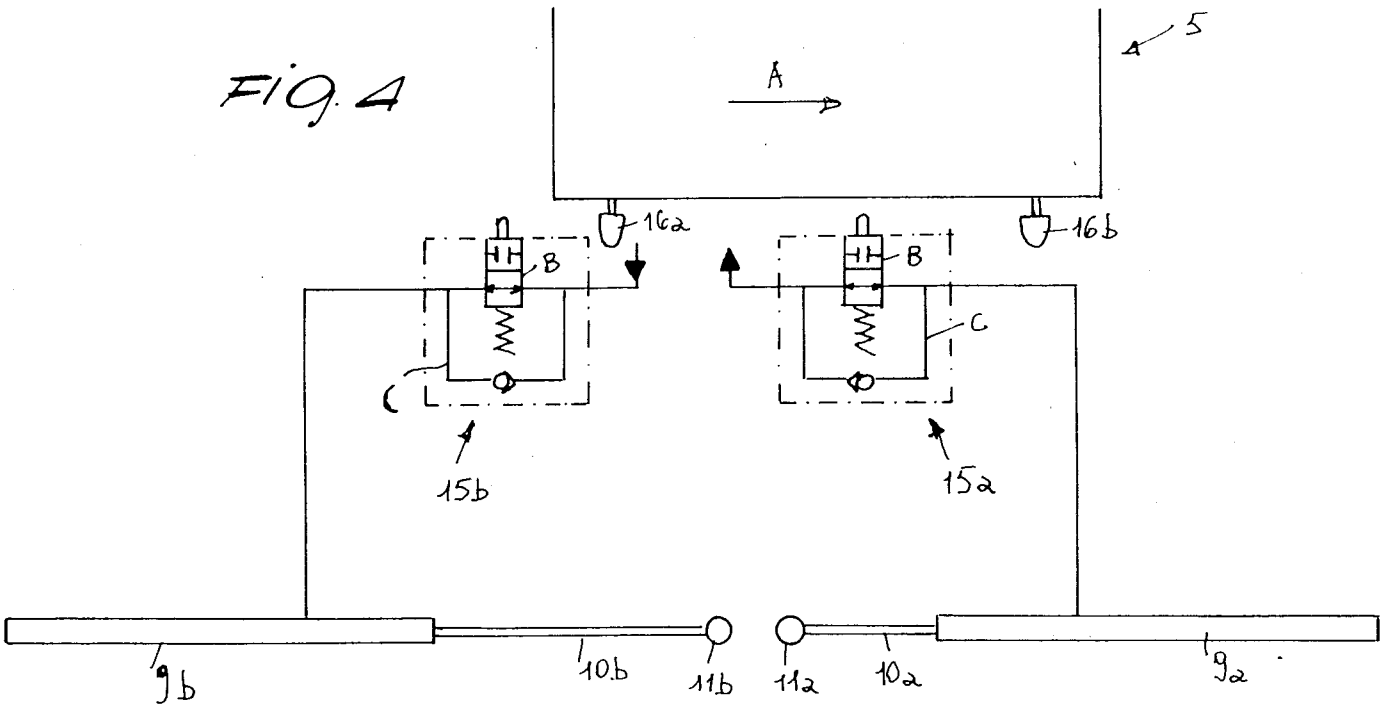
FIG. 4 is a diagramatic detail elevation of a stroke limiting device.

The reciprocating movements of the carriage 5 are effected by two horizontally opposed hydraulic jacks which extend longitudinally to the platform 3 and, are located between the runways 4, platform 3, and cross-beam assembly 7 of the carriage. The cylinders and piston rods of such jacks are respectively indicated at 9*a* and 9*b*, and 10*a* and 10*b*; the cylinders are attached to the platform 3, and the piston rods are arranged to face each other and the platform center, and outwardly of the respective cylinder are terminated to carry pivotally about a horizontal axis a respective pulley 11*a* and 11*b*. Trained around each of the pulleys is a respective chain 12*a* and 12*b*. Each chain has a lower end connected to a respective cylinder, and an upper end connected to the carriage 5, at the longitudinal end of the latter located near the cylinder of the respective jack. The lower runs of the chains are caused to slide along respective guide strips attached to the platform 3, while under the upper runs of those same chains are respective panel members, each panel member having one end attached to the respective piston rod near the free end of the latter and being then laid to slide on the respective cylinder; in the figures, designated with 13*b* and 14*b* are the strip and panel relating to the jack 9*b*-10*b*. It is envisaged that the jacks 9*a*-10*a* and 9*b*-10*b* are direct acting ones and it is preferred that the active stroke of the piston rod 10*a* of the jack closest to the cab 1 be faster than the piston rod 10*b*. Along the feed and discharge pipe of the jack 9*a*-10*a* there is located a stroke limiting device comprising a sensor valve 15*a*, wherewith the camming element 16*a*, secured to the carriage 5, is adapted to be actuated as the carriage, driven by the jack 9*b*-10*b*, is about to reach its forward stroke limit device, near the cab 1; the same holds true for the carriage rearward stroke limit device, the similar elements being indicated at 15*b* and 16*b*, while it should be pointed out that the camming elements 16*a* and 16*b*, mounted rigidly to the carriage 5, as they proceed, cover a diverse trajectory so as to interfere only with sensor valves 15*a* and 15*b* respectively. When the carriage 5 moves in the direction "A" towards the forward stroke limit device, oil is fed under pressure to the cylinder 9*b* through the two-way distributor B, associated with the sensor valve 15*b*, said distributor being in its normal position; whilst the cylinder 9*a* is discharging through the distributor associated with the sensor valve 15*a*. When the carriage 5 is reaching its forward stroke limit device, the distributor associated with the sensor valve 15*a* is actuated by the camming element 16*a*: resultantly the cylinder 9*a* ends discharging, and the carriage stops. At this point, in order to enable the carriage to transfer towards its rearward stroke limit device, oil is introduced under pressure into the cylinder 9*a*. Until such time as the camming element 16*a* no longer interferes with the sensor valve 15*a*, the oil is delivered to said cylinder through the respective conduit C, which is provided with a suitable one-way valve and bypasses the distributor B of the sensor itself (See FIG. 4). The sensor valves may be of the type produced by Duplomatic S.p.A.—Busto Arsizio (Province of Varese) ITALY.

Close to the right-hand edge of the platform 3 and close to the leading edge of the carriage 5, that same carriage is provided with a platform on which there is rotatably mounted about a vertical axis, a tower 17 of sort; rotation of the tower 17 is determined by a double acting hydraulic jack 18, interposed between said tower and the carriage. The jack 18 and other jacks, which will be discussed hereinafter, follow the strokes of the carriage 5, and via partially flexible pipes, are connected to a hydraulic unit, carried on the platform 3 and not shown; to appropriately proceed the strokes of the carriage 5, sections of such tubes are accordingly housed in a cable sheath 19, for example of the type produced by Brevetti Stendalto—MONZA (Province of Milano) ITALY, which has an upper end connected to the carriage and a lower end secured to the platform at about half its length. Above the jack 18, the carriage 5 has a partly covering bonnet 20, whereabove a footboard 21 is secured to the rotatable tower 17; the footrest supports at a given height a set 22 of levers for controlling the rigged portion of the truck. A seat 23 is made available to the operator which is mounted rotatably at the top of the tower 17; in order to reach the footrest 21 and seat, a ladder 24 is available which is only shown in FIG. 2. At the top, the ladder is hinged to the right-hand lateral side 6 of the carriage, along a horizontal axis 25, parallel to the lateral side itself; the ladder is contiguous to a handrail 26, which the carriage 5 has at its leading edge; the ladder is raised, and hooked to said handrail when, not in use, and the truck is moving.

Figure 2:
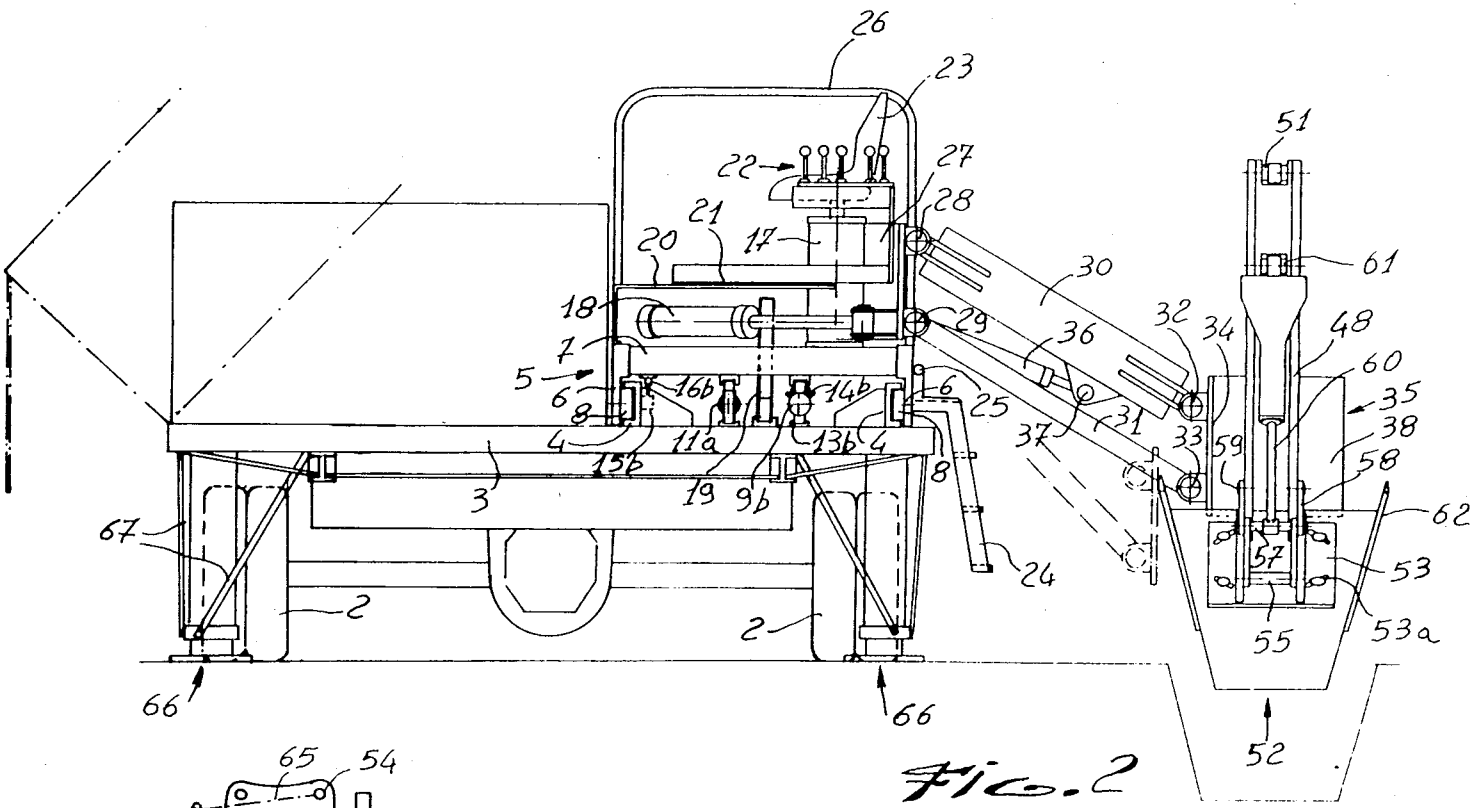
FIG. 2 is a rear elevation view of that same truck.

To a lateral enlargement 27 of the tower 17, on horizontal pivots 28 and 29, there are pivoted respective rod-like elements 30 and 31 of an articulated parallelogram; such elements are also pivoted, at 32 and 33, to a vertical wall 34 of a main support 35. A hydraulic jack 36 is interposed between the pivot 29 and a pivot 37 engaged by the rod-like element 30. The hydraulic jack 36, which controls that articulated parallelogram, determines the raising or lowering of the main support 35 with respect to the level of the carriage 5 and parallely to the axis of the tower 17, whereon that same support is cantilevered; of course, such lowering of the support, as schematically indicated in dash-and-dot lines in FIG. 2, is allowed when that same support does not overlie the platform 3. To one vertical wall 38, which the support presents perpendicularly to the wall 34, there is mounted rotatably about a vertical pivot 39 a secondary support 40 the angular excursions whereof are determined by a pair of hydraulic jacks 41.

Downwardly the support 40 carries oscillatingly about a horizontal pivot 42 one end of an arm 43; the angular excursions of said arm are determined by a hydraulic jack 44 (partly shown in FIG. 1), which engages at 45 and 46 respectively with the secondary support arm itself. The other end of the arm 43 carries oscillatingly, by means of a pivot 47, a boom 48; the angular excursions of the boom relatively to the arm are determined by a hydraulic jack 49, which is articulated to the arm and boom respectively at 50 and 51. The boom 48 is terminated with a tool. In the figures, wherein reference is made to ditch maintenance work and hence to excavation and lifting of material from a deeper level to that of the trucks' rest surface, such a tool has been represented in the form of an inverted bucket 52. A plate hitch 53 is attached to the bucket upper wall. That plate is articulated at 54 to the end of the boom 48 and at 55 is articulated to elements 56, which at 57 are articulated to other elements 58, pivoted at 59 to the boom 48. The angular movements of the bucket with respect to the boom are, therefore, determined by a jack 60, interposed between the articulation 57 and a pin 61 engaged by the boom.

Figure 3:
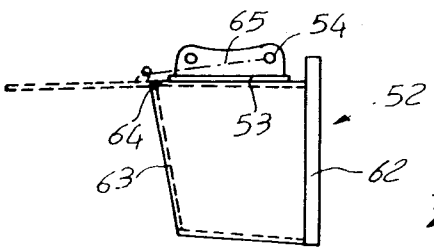
FIG. 3 is a detail view of the bucket implement.

The bucket has given ability to work on slightly angled vertical plane with respect to that shared by the arm 43 and boom 48: the plate 53 (FIG. 2) is, in fact, provided with arcuate slots **53*a*, wherein there engage the locking bolts of the bucket to that same plate. The mouth and cross-section of the bucket is trapezoidal so as to follow the ditch section pattern; the bucket mouth is provided with cutting edges 62. It is envisaged (FIG. 3) that the wall 63 of the bucket, opposite the mouth thereof, is liftable as indicated by section lining in the figure itself: that is, it is envisaged that the upper edge of the wall 63, at 64, be articulated to the corresponding edge of the upper wall of the bucket and that a pair of jacks 65 be interposed between the articulation 54 and a lug of the wall 63**.

The truck platform is provided with a set of four legs 66, extendible independently: they form, in fact, hydraulic jacks; the cylinders of such jacks are attached to the platform 3 and suitably propped by rods 67. It is preferred that for its part, which is not occupied by the runways 4 and unaffected by the runs of the carriage 5, on the truck platform there be disposed a loading body 68, tiltable in a known manner, about the left-hand longitudinal side of the truck, as shown in dash-and-dot in FIG. 2. It is also expedient that a clinometer 100, e.g. of the pendulum type, be mounted on the truck platform, such as to indicate the inclination assumed by the longitudinal axis of the platform with respect to the horizontal plane.

The operation of the cited truck will now be described with particular reference to the maintenance of ditches adjacent to roads, i.e. with the clearing thereof from weeds, debris, and refuse of various description. Upon the truck reaching the worksite and being driven longitudinally alongside the ditch, the truck driver himself or an accompanying operator provides for the legs 66 to be lowered and brought to engage with the ground; the extend of the extension which is caused to be assumed by the legs is such that said clinometer 100 indicates the required inclination which is determined by the operating conditions at the worksite. By suitable operations, it is then provided for displacing the arm 43 and boom 48 from their inactive position on the truck platform: in essence, the tower 17 is made to rotate until the articulated parallelogram 30-31-35 disposes itself outwardly and perpendicularly to the right-hand edge of the truck; one brings the carriage 5 to its forward stroke limit device; one further disposes the plane of the arm 43 of the boom 48 substantially perpendicular to the plane of the articulated parallelogram, and with the bucket 52 facing the rear portion of the truck, it is caused to move down in the working position. Especially if the amount of material to be moved is of some importance, the wall 63 of the bucket is opened. Thus, by causing the carriage 5 to run toward its forward stroke limit device, the ditch walls are scraped without the excess material being removed and also without subjecting the apparatus to excessive stresses. In this manner one moves easily, after closing the bucket, to steps of collection, lift and discharge of the excess material. The apparatus has a long range, thereby the bucket may also be unloaded into the body of a second truck, placed aligned to the rigged truck, showing its rear portion to facilitate loading. The bucket may also be unloaded onto the body 68, juxtaposed to the runways 4. Once the body 68 has been filled or processing of the ditch section corresponding to the stroke length of the carriage 5 completed, the rigged truck, on raising the legs 66, and bringing the arm and boom to an inert position, moves away either to take the material built up in its body to a dump site, or to process another section of the ditch. It is clear that the operational peculiarities of the rigged truck are wide and varied, as are the types of jobs for which it may be used, even with just one operator driver. In fact, additionally to affording fast haulage of material, it can load-unload and process materials of various kinds. To that aim, to the boom 18, may be applied a straight bucket, grab bucket, small grading blade, hoisting hook, etc. One may envisage, for example, that the truck carries bituminous conglomerates and lays them down as pavement blankets.

I claim:

1. A rigged truck, characterized in that it comprises runways defined on the truck platform and extending longitudinally thereto close to a corresponding side thereof, a carriage mounted for controlled movement along said runways, a tower mounted for contolled rotation on said carriage and having at the top a rotatable seat for an operator, a main support carried, through a horizontal axis articulated parallelogram, cantilever-fashion on said tower and being controllably movable in a vertical direction, a secondary support mounted for controlled rotation about a vertical axis on said main support, an arm mounted to oscillate at one end thereof, under control and on a horizontal axis substantially parallel to the plane of said articulated parallelogram, to said secondary support, a boom mounted for controlled oscillation to the other end of said arm and being terminated with a tool, preferably an implement of the bucket type.

2. A truck according to claim 1, characterized in that said platform is provided with independently extendable legs adapted to engage with the ground and to cause said platform to assume a desired longitudinal slope as checked through a clinometer mounted on said platform.

3. A truck according to claim 1, characterized in that said carriage is driven by a pair of horizontally opposed hydraulic jacks through chains trained around pulleys respectively mounted idle on the free end of the pistons rods of said jacks.

4. A truck according to claim 1, characterized in that, juxtaposed to said runways on the truck platform, there is defined a tilting loading body, preferably tiltable about the longitudinal side of the platform, free from said runways, which side is preferably the truck driving side.

5. A truck according to claim 1, characterized in that said tower carries a footrest secured thereto which supports control levers at a given height level and can be reached from a ladder carried tiltably on said carriage.

6. A truck according to claim 1, characterized in that said tower is carried rotatably on said carriage close to said side of the platform and to the edge of the carriage.

7. A truck according to claim 1, characterized in that said bucket is of the inverted type, having a mouth provided with cutting edges and the opposite wall tiltable upwards.

8. A truck according to claim 1, characterized in that said bucket has a hitch plate angularly adjustable with respect to the bucket itself.

* * * * *